US007721683B2

(12) United States Patent
Lutz et al.

(10) Patent No.: US 7,721,683 B2
(45) Date of Patent: May 25, 2010

(54) INTEGRATED ENGINE THERMAL MANAGEMENT

(75) Inventors: Martin Lutz, Cologne (DE); Carsten Weber, Leverkusen (DE); Jan Mehring, Cologne (DE); Ingo Lenz, Cologne (DE); Kai Sebastian Kuhlbach, Bergisch Gladbach (DE); Richard Fritsche, Wermelskirchen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 72 days.

(21) Appl. No.: 12/015,743

(22) Filed: Jan. 17, 2008

(65) Prior Publication Data

US 2008/0168956 A1 Jul. 17, 2008

(30) Foreign Application Priority Data

Jan. 17, 2007 (EP) ..... 07100654

(51) Int. Cl.
*F01P 7/14* (2006.01)

(52) U.S. Cl. ..... 123/41.1

(58) Field of Classification Search ..... 123/41.02, 123/41.1, 41.29, 41.51, 41.67, 41.72, 41.82 R, 123/41.08; 165/51
See application file for complete search history.

(56) References Cited

U.S. PATENT DOCUMENTS

2006/0000430 A1 * 1/2006 Takahashi ..... 123/41.72

FOREIGN PATENT DOCUMENTS

| | | | |
|---|---|---|---|
| EP | 1375857 | A | 1/2004 |
| EP | 1375857 | A1 | 1/2004 |
| EP | 1 698 770 | A1 * | 9/2006 |
| FR | 2855555 | A1 | 12/2004 |
| FR | 2 860 833 | A1 * | 4/2005 |
| FR | 2860833 | A1 | 4/2005 |
| JP | 8218873 | A | 8/1996 |

* cited by examiner

*Primary Examiner*—M. McMahon
(74) *Attorney, Agent, or Firm*—Julia Voutyras; Brooks Kushman P.C.

(57) ABSTRACT

The invention relates to a cooling strategy for an internal combustion engine (1) which has at least one cylinder head (2) and an associated cylinder block (3). A coolant flows in a coolant circuit (4), with at least one control element (6, 7, 8, 9) being assigned to the coolant circuit (4). During a warmup of the internal combustion engine, in successive phases, the coolant flow is conducted to separate cooling regions by the control elements (6, 7, 8, 9), wherein in an operating mode at operating temperature which follows the warmup, the coolant flow is conducted to separate cooling regions by the control elements (6, 7, 8, 9) taking into consideration the operating states of the internal combustion engine.

21 Claims, 6 Drawing Sheets

Figure 6

| Integrated Engine Cooling System With Separate Control of the Cylinder Head Intake Side, Exhaust Side, and Cylinder Block | | | | | | |
|---|---|---|---|---|---|---|
| Temperature | Coolant temp. T1 or exhaust gas temp. < operating temp. of catalytic converter | Coolant temp. T2 or component temp. < critical component temp. | Coolant temp. T3 < homogenization temp. | Coolant temp. T4 < max. coolant temp. | Coolant temp. T5 = max. coolant temp. | Coolant temp. T6 = homogenization temp. |
| | Warm-running phase | | | | Engine at Operating Temp. | |
| Phase | Phase 1 | Phase 2 | Phase 3 | Phase 4 | Phase 5 | Phase 6 |
| Strategy | No coolant throughflow; improved structure, oil, and engine warmup | Cooling of the outlet ducts and of the exhaust manifold; energy for heater | Cooling of cylinder head outlet side, ducts and manifold, and of cylinder block; cooling of critical regions | Cooling of the whole engine, w/o radiator and w/o overflow reservoir throughflow; homo-genization of engine temp. distribution | Cooling of the cylinder head outlet side and of the cylinder block | Cooling of the whole engine, with radiator and with compensating take throughflow |
| Advantages over conventional system | | | | | | |
| Passenger compartment warmup | No influence | Transport of heat into coolant precisely where heat is generated | Transport of heat into coolant precisely where heat is generated | | Not critical in this phase | Not critical in this phase |
| Knock sensitivity | Not critical in this phase | Not critical in this phase | Not critical in this phase | | Not critical in this phase | Lower gas temperature |
| Volumetric efficiency | Not critical in this phase | Not critical in this phase | Not critical in this phase | | Not critical in this phase | Lower inlet gas temperature |
| Power consumption of water pump | P=dP*V/eta | | | | | Not critical in this phase |
| Thermal efficiency | Lower thermal losses in combustion chamber | Lower thermal losses in comb. chamber | | Lower thermal losses in combustion chamber | Lower thermal losses in comb. chamber | Not critical in this phase |
| Friction/oil warmup | Improved, if no oil/water heat exchanger | Improved, if no oil/water heat exchanger | | Greater heat transfer to oil as a result of higher temperature level | Improved, if no oil/water heat exchanger | Not critical in this phase |
| Catalytic converter attains activation temperature | Lower thermal losses at exhaust gas side | Not critical in this phase | Not critical in this phase | | Not critical in this phase | Not critical in this phase |
| Durability | Not critical in this phase | Not critical in this phase | Not critical in this phase | | Not critical in this phase | Lower structure temperature |

INTEGRATED ENGINE THERMAL MANAGEMENT

FIELD OF THE INVENTION

The invention relates to a cooling strategy for an internal combustion engine which has at least one cylinder head and an associated cylinder block, with a coolant flowing in a coolant circuit, and with at least one thermostat in the coolant circuit.

BACKGROUND OF THE INVENTION

EP 1 375 857 A discloses a cooling system for an internal combustion engine having a plurality of cooling cells in a cylinder head. The cooling cells are separated from one another. The cooling system also includes at least first and second control elements for regulating the throughflow quantity. The control elements are capable of regulating the quantity of cooling liquid which flows in through the first and second cooling cells.

It is known for the engine block and the cylinder head of the internal combustion engine to be traversed by a coolant of a coolant circuit separately from one another. In this way, it is possible for the cylinder head and the block to be cooled differently. By a split cooling circuit, during warmup, the cylinder is cooled and the block is not so that it comes to a suitable operating temperature more quickly.

SUMMARY OF THE INVENTION

A cooling system for an internal combustion engine with coolant flowing in a coolant circuit 4 is disclosed in which the engine has a cylinder head 2 and an associated cylinder block 3 with a block cooling jacket 12. The cooling system has a pump 21 disposed in the coolant circuit 4 upstream of the internal combustion engine. There are an exhaust cooling jacket 13 and an intake cooling jacket 16 disposed in the cylinder head 2 with the exhaust and intake cooling jackets being separated. A heater is disposed in the coolant circuit 4 upstream of pump 21. A first valve 6 is disposed in the coolant circuit 4 located between the exhaust cooling jacket 13 and the heater 17. Coolant flows from the exhaust cooling jacket 13 to the heater when first valve 6 is open and is substantially prevents flow when the first valve 6 is closed. A second valve 7 is disposed in the coolant circuit 4 connected to receive coolant from the first valve 6 and from the intake cooling jacket 16. When the second valve 7 is closed, flow from the intake cooling jacket 16 is prevented. A third valve 8 is disposed in the coolant circuit 4 connected to receive coolant from the second valve 7 and from the block cooling jacket 12. When the third valve 8 is closed, flow from the block cooling jacket 12 is prevented. A fourth valve 9 is disposed in the coolant circuit 4 connected to receive coolant from the third valve 8. A radiator 19 having a line connected to an upstream side of said pump and a line connected to said fourth valve 9 is disposed in the coolant circuit 4. When the fourth valve is in a closed position, flow to the radiator 19 ceases.

In one embodiment, the first, second, and third valves are mechanical thermostats. Alternatively, the first thermostat is electrically actuated.

An opening temperature of the first valve 6 is lower than an opening temperature of the third valve 8. An opening temperature of the third valve 8 is lower than an opening temperature of the second valve 7.

The first valve 6 is actuated to open based on an exhaust temperature exceeding a predetermined threshold. In one embodiment that exhaust temperature is an estimate of catalytic converter temperature.

The engine has a coolant distributor 11, which receives coolant flow from the pump 21 and connects to the exhaust cooling jacket 13, the intake cooling jacket 16, and the block cooling jacket 12.

Also disclosed is a method of providing a cooling system and coolant circuit 4 for an internal combustion engine. A pump 21 is in the coolant circuit 4 upstream of the internal combustion engine. The cylinder head is provided with separated exhaust 13 and intake 16 cooling jackets. A heater, air-to-coolant heat exchanger for warming up a vehicle cabin, is disposed in the coolant circuit 4 upstream of the pump 21. Also provided are a first valve 6, a second valve 7, and a third valve 8 in the coolant circuit 4. The first valve 6 is disposed in the coolant circuit 4 between the exhaust cooling jacket 13 and the heater 17. When the first valve is open, coolant flows from the exhaust cooling jacket 13 to the heater and flow is substantially stopped when first valve 6 is closed. The second valve 7 is disposed in the coolant circuit 4 connected to receive coolant from the first valve 6 and from the intake cooling jacket 16. When the second valve 7 is closed, flow from the intake cooling jacket 16 ceases. The third valve 8 is disposed in the coolant circuit 4 connected to receive coolant from the second valve 7 and from the block cooling jacket 12. When the third valve 8 is closed, flow from the block cooling jacket 12 ceases.

The first valve 6 is, in one embodiment, electronically actuated based on an estimate of exhaust temperature. It is caused to open when the exhaust temperature exceeds a threshold. The exhaust temperature can be a catalytic converter temperature.

A fourth valve 9 is disposed in the coolant circuit 4 connected to receive coolant from the third valve 8. Also, a radiator 19 having a line connected to an upstream side of the pump 21 and to the fourth valve 9 is provided. When the fourth valve is in a closed position, flow to radiator 19 ceases. In one embodiment, the second, third, and fourth valves 7, 8, 9 are mechanical thermostats and an opening preset temperature of the fourth valve 9 is higher than opening present temperatures of the second and third valves 7, 8.

The invention is based on the knowledge that cooling water jackets have the main function of dissipating the heat generated as a result of the combustion, wherein the cooling water jackets should be designed such that the temperature distribution is homogeneous. It is therefore predominantly provided that the cooling water jacket is designed for full-load operation, in which a maximum temperature is generated. However, by the invention, which provides integrated engine cooling management or a cooling strategy, it is possible to obtain both the advantages of good oil warm-up, exhaust gas warm-up, engine warm-up and passenger compartment warm-up already in the warm-running phase of the internal combustion engine, and also good cooling of the engine at operating temperature.

It is therefore advantageously provided that, in a first phase of warmup, the coolant has a flow value of zero, with the corresponding, first control element (valve 6) being closed. The control element can for example be an electromechanical valve or electrically-heated thermostat controlled based on exhaust gas temperature. Directly after the internal combustion engine is started, the exhaust gas temperature has not yet reached the desired temperature value, so that the valve is initially closed, preferably for a number of seconds, so that a coolant flow is initially interrupted. In first phase of warmup, this leads to significantly improved catalytic converter warm-up and also to a faster structure warm-up and, therefore, oil warmup. The desired temperature on which to base opening temperature can be operating temperature of the catalytic converter, and can have, in one example, a value of about 500° C. (catalytic converter lightoff temperature) of the exhaust gas temperature.

Once the exhaust gas temperature has reached the lightoff temperature of the catalytic converter, the firat valve 6 opens, as the second phase of warmup begins. The exhaust ducts and exhaust gas manifold are provided coolant, so that coolant flows through an exhaust gas side of the cylinder head to a heater 17. In this way, the thermally highly loaded regions of the internal combustion engine, in particular the exhaust gas side, are cooled, with the coolant absorbing the generated heat and the coolant then flowing into the heater 17, so that the passenger compartment can be warmed up more quickly by the heater 17 as a result of the lower thermal masses.

It is also provided within the context of the invention that, in a third phase of the warmup, the exhaust ports and exhaust gas manifold and the cylinder block are cooled, with the exhaust gas control element or the valve 8, or a block thermostat, being opened, so that the coolant flows through the exhaust gas side 13 of the cylinder head and the cylinder block 12 to the heater. It is provided, in a fourth phase of the warm-up, that the entire internal combustion engine is cooled, with the exhaust gas control element or valve 7, a second control element or a thermostat, and the third control element (valve 8) or the block thermostat, being opened, so that the coolant flows through an exhaust gas side of the cylinder head and through the inlet side of the latter and also through the cylinder block to the heater.

When the engine is at operating temperature (phase 5), it is provided that, in addition to the coolant flow through the heater 17 described in phase 4, the coolant flows through a radiator 19 and an overflow tank 18. For this purpose, it is possible to provide a conventional thermostat or a characteristic-map-controlled valve (characteristic map thermostat) as a fourth control element (valve 9).

The four control elements specified by way of example are preferably arranged in series, with successive control elements being connected to one another by means of connecting lines.

After the internal combustion engine has reached its operating temperature, it is advantageously provided that different cooling strategies can be used depending on the operating state of the internal combustion engine. It is favorably provided, in a part-load operating mode of the internal combustion engine, that the outlet side of the cylinder head and the cylinder block are cooled, with the coolant flowing through the exhaust gas side of the cylinder head and through the cylinder block to the heating heat exchanger. In a full-load operating mode of the internal combustion engine, it is advantageously provided that the entire internal combustion engine is cooled, with the coolant flowing through the exhaust gas side of the cylinder head and through the inlet side of the latter and also through the cylinder block to the heating heat exchanger, to the radiator and also to a compensating tank.

As already stated above, in the first phase of warmup, the exhaust gas control element is preferably controlled by the exhaust gas temperature. Here, the valve (valve 6) preferably opens when an operating temperature of the catalytic converter is reached, which can be the case already after a few seconds after the internal combustion engine is started. From the second phase of warmup, the corresponding control elements are controlled by the coolant temperature, as a result of which the corresponding control elements are designed as a thermostat, preferably as a single-acting thermostat. To actuate the respective control element or thermostat, the coolant temperature is preferably less than 50° C. in the second phase, wherein the coolant temperature can have a value between 50 and 80° C. in the third phase, and wherein a coolant temperature of between 80 and 110° C. can be present in the fourth phase. In the fifth phase which follows the fourth phase of warmup, the engine has reached its operating temperature. The coolant temperature is regulated between 80° C. (full load) and 110° C. (part load) as a function of the engine operating point. The temperatures or temperature ranges which are specified are of course not intended to be limiting, but are provided for purposes of illustration.

To carry out the method according to an aspect of the present invention, one control element is assigned to an exhaust gas side of the cylinder head, to an inlet side of the cylinder head and to the cylinder block, with it being possible for a further control element or thermostat to be controlled by a characteristic map (characteristic map thermostat), with the control elements being separately actuable, so that in a warmup phase of the internal combustion engine and in a following operating mode at operating temperature, separately selectable cooling regions can be traversed by the coolant.

It is favorable, within the context of the invention, if the coolant circuit has a cylinder block water jacket and a cylinder head water jacket which is divided into an inlet-side water jacket and an exhaust-gas-side water jacket, a so-called "split cooling system" (split cooling circuit, cylinder head), with it being possible for a coolant distributor to be assigned to the coolant circuit.

Provided overall, therefore, is an integrated and flexible heat management system for an internal combustion engine, in which a energy is transferred from a source to a sink within the engine and the motor vehicle, or any other application, as a function of the operating states of the internal combustion engine and the respective demands of the vehicle occupants. This advantageously provides for avoiding heat transfer in specific regions as long as the internal combustion engine is cold. This corresponds for example to the first phase of the warm-running phase of the internal combustion engine, in which no coolant flows. At the same time, it is advantageously obtained that a heat flow directly into the passenger compartment is obtained as quickly and effectively as possible. The cooling regions can of course themselves be divided up, with in particular the "split cooling system" (split cooling circuit, cylinder head) being considered here.

A faster warm-up of the internal combustion engine is advantageously obtained by the strategy according to the invention and the special design of the internal combustion engine, with harmful emissions to the environment being simultaneously reduced. In addition, friction losses are minimized because the engine oil is brought to its operating temperature more rapidly, and fuel consumption is therefore improved.

BRIEF DESCRIPTION OF THE DRAWINGS

FIG. 6 is a table identifying the features of the phases.

In the figures, identical parts are provided with the same reference symbols, and parts are generally also described only once.

DETAILED DESCRIPTION

Figure 1:
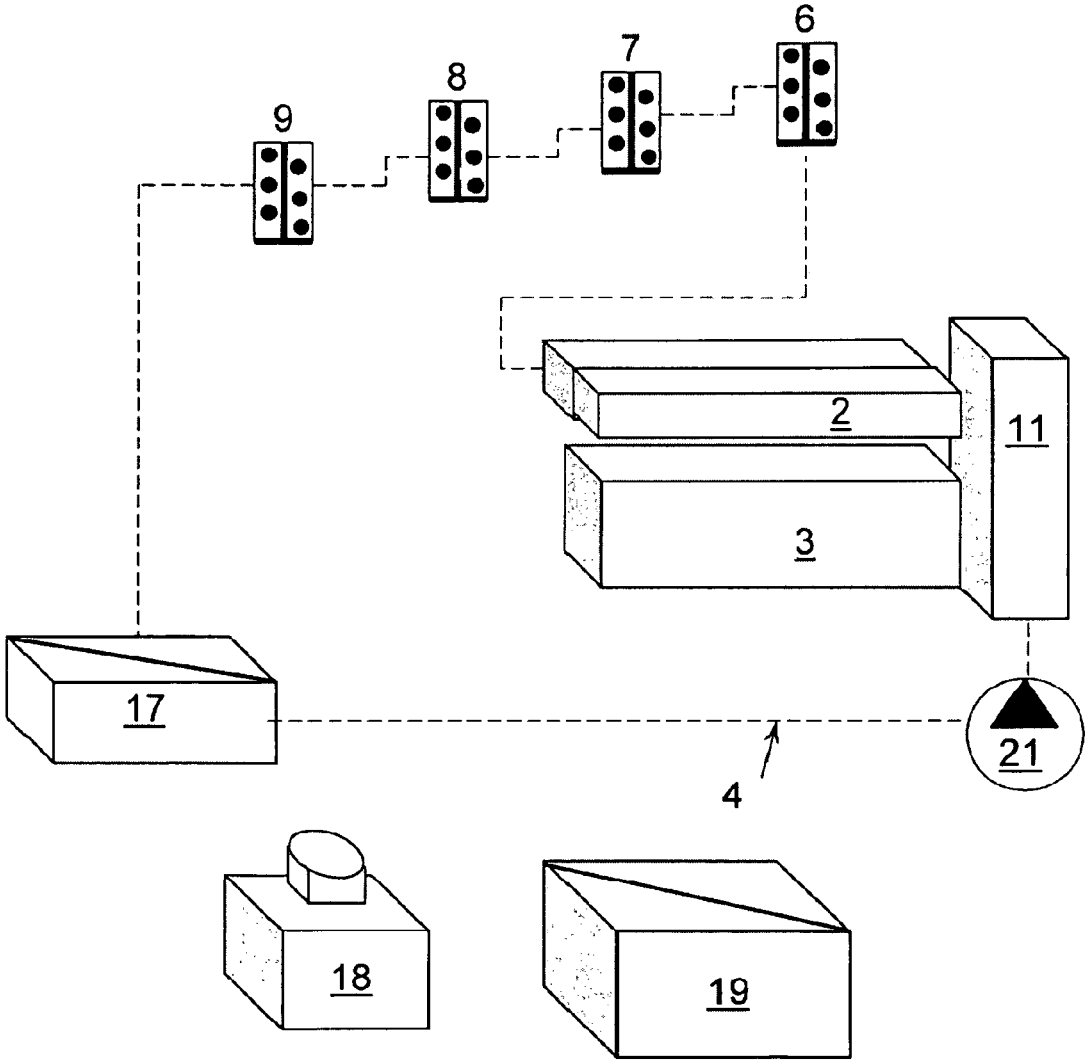
FIGS. 1-5 show a schematic of a thermal management system of an internal combustion engine, at a range of phases during warmup.

FIGS. 1-5 show a cooling system for an internal combustion engine 1 which has at least one cylinder head 2 and an associated cylinder block 3. A coolant flows in a coolant circuit 4 having four control elements 6, 7, 8, and 9.

The internal combustion engine 1 has a coolant distributor 11 supplying a cylinder block water jacket 12 and a cylinder head water jacket which is divided into an exhaust gas side 13 and an inlet side 16.

The coolant circuit 4 also has a heater 17 (e.g., an air to coolant heat exchanger used for heating the vehicle cabin, the large arrow above 41 an below 40 heater 17 indicating air flow across heater 17), an overflow reservoir 18, a radiator 19 and a pump 21. Radiator 19 is an air to coolant heat exchanger with the large arrows shown above 43 and below 42 radiator 19 indicating air flow across radiator 19. In FIG. 5, the piping and connections between the various elements are shown; while, in FIGS. 1-4, much of it is not shown to aid in simplifying the discussion of those phases of operation. Of course, the piping and connections exist in all configurations whether or not there is flow through the various regions of coolant circuit 4.

The exhaust gas side 13 of the cylinder head water jacket is coupled to a first control element 6. The inlet side 16 of cylinder head water jacket 13 is coupled to a second control element 7. The cylinder block water jacket 12 is coupled to a third control element which is embodied as a thermostat (block thermostat). In addition, fourth control element, valve 9, control element is arranged in the internal combustion engine 1. Control elements 7, 8, and 9 may alternatively be electrically operable valves or thermostats.

FIG. 1 illustrates the condition in the coolant circuit 4 just after startup of a cold engine (phase 1). All control elements 6, 7, 8, and 9 are closed, so that no coolant flows in coolant circuit 4. In one embodiment, opening of valve 6 is based on exhaust gas temperature. Faster warm-up of a catalytic converter and engine oil is obtained by interrupting flow in the coolant circulation. The interruption in the coolant flow in coolant circuit 4 is illustrated by the connecting lines being elements shown as dashed lines; the coolant flow is substantially zero.

Although engine oil and the engine structure are rapidly warmed up during phase 1 (FIG. 1), there is no flow to the heater 17. Thus, there is no appreciable warming of the passenger compartment.

Figure 2:
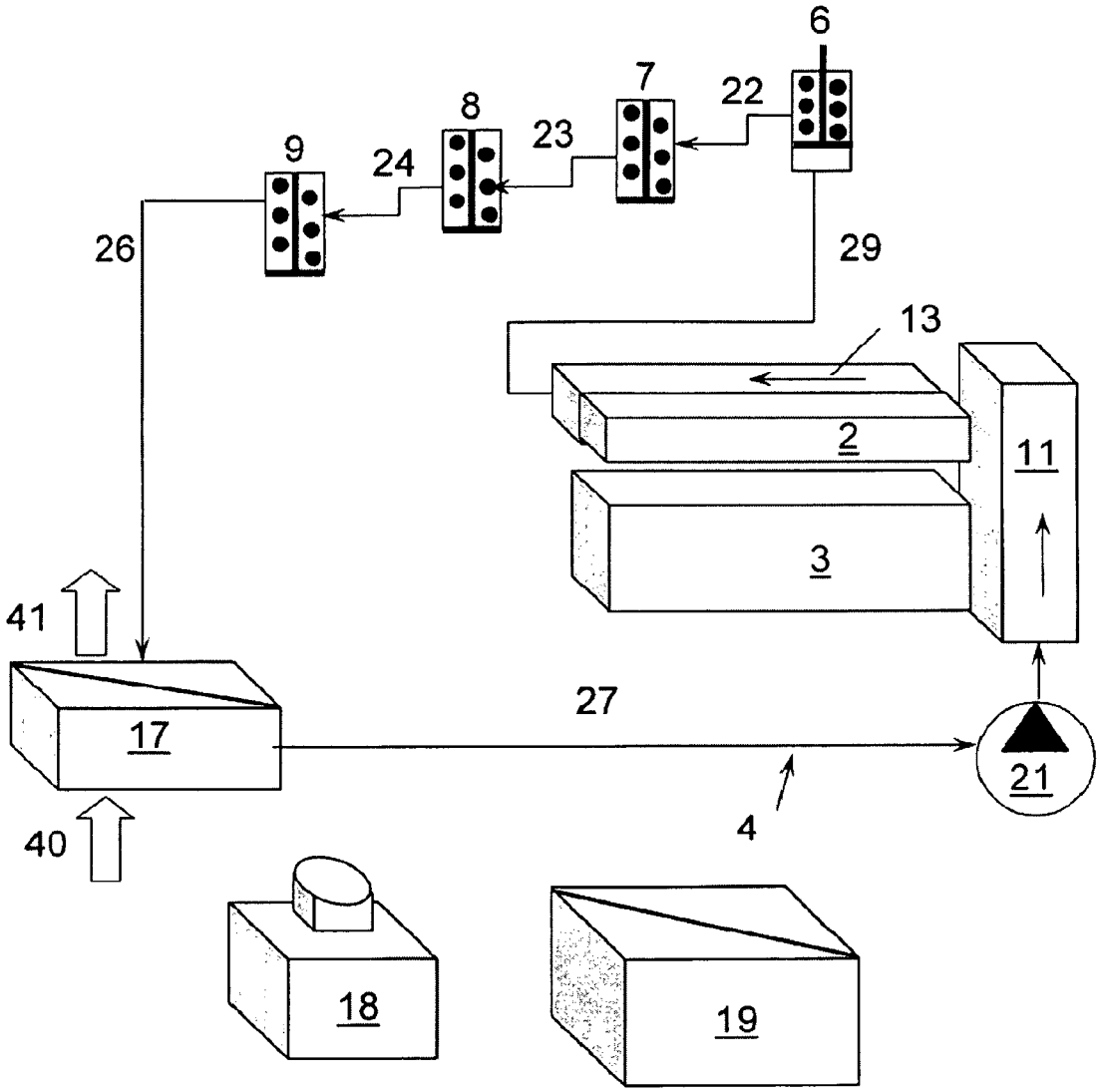

Once the exhaust gas temperature reaches, for example, the operating temperature of the catalytic converter, valve 6 opens, as illustrated in FIG. 2, (phase 2). The coolant flows through the exhaust gas side 13 of the cylinder head water jacket to the heater 17. In this second phase, the exhaust ports and exhaust manifold are provided coolant through their coolant jacket. As illustrated in FIG. 2, valve 6 is connected to thermostat 7 via a connecting line 22, with thermostat 7 connected by a connecting line 23 to block thermostat 8, which is connected by a connecting line 24 to valve 9 (characteristic map thermostat). Valve 9 is connected by connecting line 26 to heater 17, which is connected to line 27 to pump 21, which transports the coolant via connecting line 28 to the coolant distributor 11. The exhaust gas side 13 of the cylinder head water jacket is connected by line 29 to valve 6.

In the second phase of the warmup, coolant is provided to the exhaust ports and exhaust manifold. The coolant flows through heater 17 to heat the passenger cabin. Because the exhaust ports and the exhaust side of the cylinder head tend to operate at a higher temperature than other components, by transported coolant from the exhaust into heater 17, the cabin of the vehicle is rapidly heated.

Figure 3:
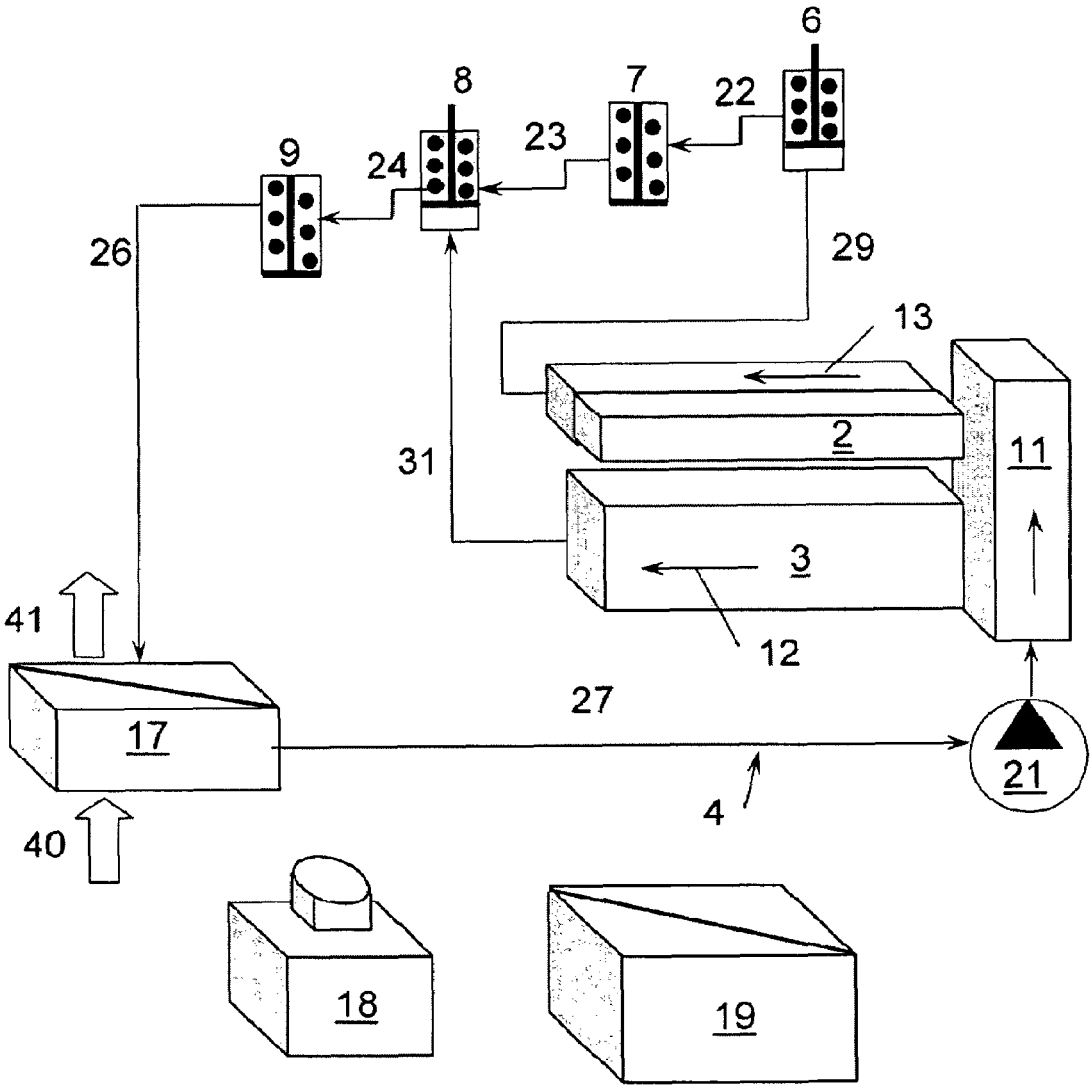

FIG. 3 illustrates a third phase of the warmup, with valve 6 and block thermostat 8 both open so that coolant flows through the exhaust gas side 13 of the cylinder head and through the cylinder block 3 or through the cylinder head water jacket to the heater 17. The cylinder block water jacket 12, connected by line 31 directly to block thermostat 8, is provided coolant flow in this configuration. Hereby, the thermally critical regions are cooled, with the transport of energy into the coolant taking place precisely where heat is generated. The two cooling regions, exhaust gas side 13 and cylinder block water jacket 12, are connected in parallel.

Figure 4:
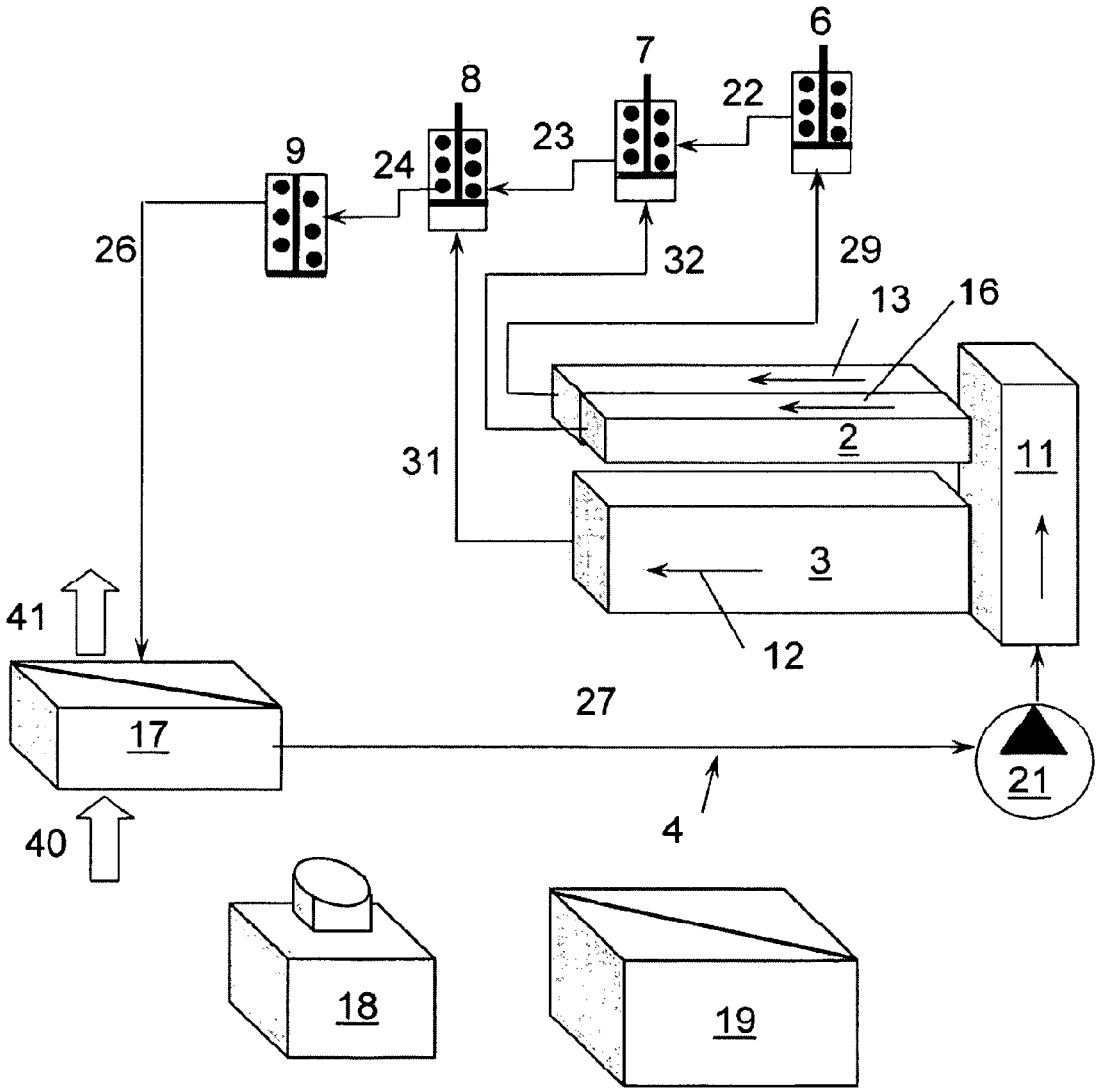
Figure 5:
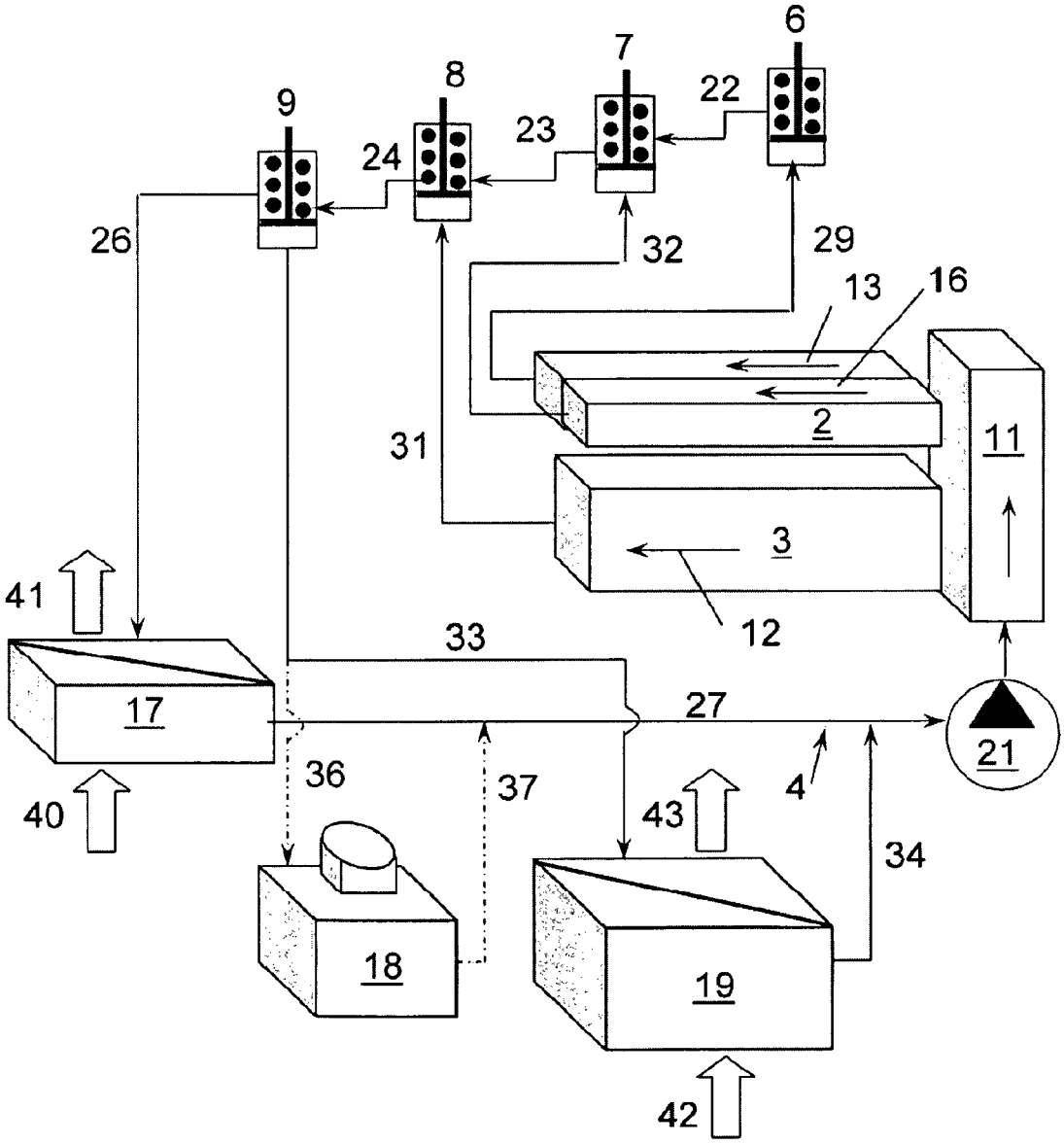

FIG. 4 illustrates a fourth phase of the warmup, in which the entire internal combustion engine 1 is cooled. Valves 6, 7, and 8 are open so that coolant flows through the exhaust gas side 13 and the intake side 16 of the cylinder head water jacket and through the cylinder block water jacket 12 to heater 17 (valve 9 remains closed). The intake side 16 of the cylinder head water jacket is connected by line 32 to thermostat 7.

In the fourth phase, a homogenization of the engine temperature distribution is obtained, with low thermal losses in the combustion chamber being obtained. At the same time, an increased transfer of energy into the oil is obtained on account of the higher temperature level. The three cooling regions, exhaust gas side 13, intake side 16, and cylinder block water jacket 12, are connected in parallel.

In a fifth phase, the engine is at operating temperature. Valves 6, 7, 8, and 9 are open, valve 9 allowing flow to radiator 29 via line 33 with return flow to line 27, which is the input to pump 21, provided by line 34. It is additionally provided that the coolant flows to overflow reservoir 18 which, in one embodiment, connects to valve 9 via line 36. Overflow reservoir 18 returns to line 27 via line 37.

FIG. 5 illustrates the cooling strategy for the internal combustion engine 1 at operating temperature under full load. Here, the entire internal combustion engine 1 is cooled, with the coolant flowing through the exhaust gas side 13 of the cylinder head water jacket and through the inlet side 16 of the latter and also through the cylinder block or the cylinder block water jacket 12 to the heater 17, to the radiator 19 and to a compensating tank 18. Valve 9 is connected by a connecting line 33 to the radiator 19, which itself opens out via a connecting line 34 into the connecting line 27 from the heater 17 to the pump 21. From the connecting line 33, a connecting line 36 branches off to the compensating tank 18, which itself is connected by a connecting line 37 to the connecting line 27 from the heater 17 to the pump 21.

FIG. 6 is a table outlining the various phases encountered in the warmup procedure and shows the various attributes and advantages during the phases according to aspects of the present invention.

It is possible for the valve 6 to be dispensed with if the pump 21 or the coolant pump in the coolant circuit 4 is replaced by a regulatable coolant pump with a zero feed option.

Not illustrated is a cooling strategy for a part-load operating mode of the internal combustion engine at operating temperature, in which the exhaust gas side 13 of the cylinder head water jacket and the cylinder block 3 or the cylinder block water jacket 12 is cooled, with the coolant flowing through the exhaust gas side 13 of the cylinder head water jacket and through the cylinder block 3 or through the cylinder block water jacket 12 to the heater 17.

We claim:

1. A cooling system for an internal combustion engine with coolant flowing in a coolant circuit (4), the engine having a cylinder head (2) and an associated cylinder block (3) with a block cooling jacket (12), the cooling system comprising:

a pump (21) disposed in the coolant circuit (4) upstream of the internal combustion engine;

an exhaust cooling jacket (13) disposed in the cylinder head (2);

an intake cooling jacket (16) disposed in the cylinder head (2) wherein said exhaust and intake cooling jackets are separated;

a heater disposed in the coolant circuit (4) upstream of said pump (21);

a first valve (6) disposed in the coolant circuit (4) located between said exhaust cooling jacket (13) and said heater (17) wherein coolant flows from said exhaust cooling jacket (13) to said heater when said first valve (6) is open and is substantially stopped from flowing when said first valve (6) is closed;

a second valve (7) disposed in the coolant circuit (4) connected to receive coolant from said first valve (6) and from said intake cooling jacket (16) wherein when said second valve (7) is closed, flow from said intake cooling jacket (16) is substantially stopped;

a third valve (8) disposed in the coolant circuit (4) connected to receive coolant from said second valve (7) and from the block cooling jacket (12) wherein when said third valve (8) is closed, flow from the block cooling jacket (12) is substantially stopped.

2. The cooling system of claim 1, wherein said second and third valves are mechanical thermostats and said first valve is actuated by an electrical signal.

3. The cooling system of claim 1 wherein said first, second, and third valves (6, 7, and 8) open based on temperature.

4. The cooling system of claim 3 wherein an opening temperature of said first valve (6) is lower than an opening temperature of said third valve (8).

5. The cooling system of claim 3 wherein an opening temperature of said third valve (8) is lower than an opening temperature of said second valve (7).

6. The cooling system of claim 1 wherein said first valve (6) is electrically actuated and is actuated to open based on an exhaust temperature exceeding a predetermined threshold.

7. The cooling system of claim 6 wherein said exhaust temperature is an estimate of a catalytic converter temperature.

8. The cooling system of claim 1, further comprising:

a fourth valve (9) disposed in the coolant circuit (4) connected to receive coolant from said third valve (8);

a radiator (19) having a line connected to an upstream side of said pump and a line connected to said fourth valve (9) wherein when said fourth valve is in a closed position, flow to said radiator (19) is substantially stopped.

9. The cooling system of claim 1, further comprising: a coolant distributor (11) as part of the internal combustion engine, said coolant distributor (11) receiving coolant flow from said pump (21) and providing connections to said exhaust cooling jacket (13), said intake cooling jacket (16), and the block cooling jacket (12).

10. The cooling system of claim 8 wherein said fourth valve is an electrically-heated mechanical thermostat such that the temperature of said fourth valve is affected by both the coolant temperature and the amount of electrical energy supplied to said electrically-heated mechanical thermostat.

11. The cooling system of claim 8 wherein said second valve (7), said third valve (8), and said fourth valve (9) are one of a mechanical thermostat, an electrically-heated mechanical thermostat, and an electrically actuated valve.

12. The cooling system of claim 1 wherein said third valve (8) opens at a temperature less than about 50° C.

13. The cooling system of claim 1 wherein said second valve (7) opens at a temperature less than 80° C.

14. The cooling system of claim 8 wherein said fourth valve (9) is open when at a temperature less than 110° C. and is closed when at a temperature greater than 110° C.

15. A method of providing a cooling system and coolant circuit (4) for an internal combustion engine, the engine having a cylinder head (2) and an associated cylinder block (3) with a block cooling jacket (12), the method comprising:

providing a pump (21) in the coolant circuit (4) upstream of the internal combustion engine;

providing an exhaust cooling jacket (13) separated from an intake cooling jacket in the cylinder head (2);

providing a heater (17) disposed in the coolant circuit (4) upstream of said pump (21), said heater (17) being adapted to provide cabin heat when air traverse said heater (17) into a vehicle cabin;

providing a first valve (6), a second valve (7), and a third valve (8) in the coolant circuit (4), wherein said first valve (6) is disposed in the coolant circuit (4) between said exhaust cooling jacket (13) and said heater (17) and when said first valve is open, coolant flows from said exhaust cooling jacket (13) to said heater and flow is substantially stopped when said first valve (6) is closed, said second valve (7) is disposed in the coolant circuit (4) connected to receive coolant from said first valve (6) and from said intake cooling jacket (16) and when said second valve (7) is closed, flow from said intake cooling jacket (16) is substantially stopped, and said third valve (8) is disposed in the coolant circuit (4) connected to receive coolant from said second valve (7) and from the block cooling jacket (12) and when said third valve (8) is closed, flow from the block cooling jacket (12) is substantially stopped.

16. The method of claim 15 wherein said first valve (6) is an electronically actuated valve, the method further comprising:

estimating an exhaust temperature; and actuating said first valve (6) to open when said exhaust temperature exceeds a predetermined threshold.

17. The method of claim 16 wherein said exhaust temperature is a temperature of a catalytic converter coupled to an engine exhaust.

18. The method of claim 15 wherein said second valve (7) and said third valve (8) are mechanical thermostats, which have a preset temperature at which they actuate and said second valve (7) has a higher preset temperature than said third valve (8).

19. The method of claim 15, further comprising: actuating said first valve (6) to open at a lower temperature than an opening temperature of said second valve (7), which is a mechanical thermostat, and an opening temperature of said third valve (8), which is a mechanical thermostat.

20. The method of claim 15, further comprising:

providing a fourth valve (9) disposed in the coolant circuit (4) connected to receive coolant from said third valve (8); and providing a radiator (19) having a line connected to an upstream side of said pump (21) and a line connected to said fourth valve (9) wherein when said fourth valve is in a closed position, flow to said radiator (19) is substantially stopped.

21. The method of claim 20 wherein said second, third, and fourth valves (7, 8, 9) are mechanical thermostats and an opening preset temperature of said fourth valve (9) is higher than opening present temperatures of said second and third valves (7, 8).

* * * * *